US006976925B2

(12) United States Patent
Owens et al.

(10) Patent No.: US 6,976,925 B2
(45) Date of Patent: Dec. 20, 2005

(54) GOLF BALL

(75) Inventors: Timothy M. Owens, Fort Mill, SC (US); Douglas P. DuFaux, Charlotte, NC (US); Mark T. Elliott, Charlotte, NC (US); Kris H. Turschmid, Charlotte, NC (US)

(73) Assignee: NanoDynamics, Inc., Buffalo, NY (US)

( * ) Notice: Subject to any disclaimer, the term of this patent is extended or adjusted under 35 U.S.C. 154(b) by 0 days.

(21) Appl. No.: 10/756,185

(22) Filed: Jan. 13, 2004

(65) Prior Publication Data

US 2004/0204266 A1 Oct. 14, 2004

Related U.S. Application Data

(60) Continuation of application No. 09/450,137, filed on Nov. 29, 1999, now Pat. No. 6,705,957, which is a division of application No. 09/008,453, filed on Jan. 16, 1998, now Pat. No. 6,004,225.

(60) Provisional application No. 60/036,196, filed on Jan. 21, 1997.

(51) Int. Cl.[7] ..... A63B 37/04
(52) U.S. Cl. ..... 473/372
(58) Field of Search ..... 473/374, 373, 473/354, 358, 371, 372, 375

(56) References Cited

U.S. PATENT DOCUMENTS

| | | | | |
|---|---|---|---|---|
| 697,816 | A | 4/1902 | Davis | |
| 700,658 | A | 5/1902 | Kempshall | |
| 713,772 | A | 11/1902 | Kempshall | |
| 1,568,513 | A | 1/1926 | Lewis | |
| 1,568,514 | A | 1/1926 | Lewis | |
| 3,031,194 | A | 4/1962 | Strayer | |
| 4,863,167 | A | 9/1989 | Matsuki et al. | |
| 4,979,746 | A | 12/1990 | Gentiluomo | |
| 5,026,067 | A | 6/1991 | Gentiluomo | |
| 5,033,749 | A | 7/1991 | Kakiuchi et al. | |
| 5,273,286 | A | 12/1993 | Sun | |
| 5,314,187 | A | 5/1994 | Proudfit | |
| 5,480,155 | A | 1/1996 | Molitor et al. | |
| 5,511,791 | A | 4/1996 | Ebisuno et al. | |
| 5,683,312 | A | 11/1997 | Boehm et al. | |
| 5,688,192 | A | 11/1997 | Aoyama | |
| 5,913,736 | A * | 6/1999 | Maehara et al. | 473/360 |
| 6,004,225 | A * | 12/1999 | Owens et al. | 473/372 |
| 6,368,237 | B1 * | 4/2002 | Sullivan | 473/378 |
| 6,612,939 | B1 * | 9/2003 | Sullivan et al. | 473/374 |
| 6,705,957 | B2 * | 3/2004 | Owens et al. | 473/372 |

FOREIGN PATENT DOCUMENTS

| | | |
|---|---|---|
| GB | 24471 | 8/1913 |
| GB | 109374 | 9/1917 |
| GB | 2 167 309 | 5/1986 |
| GB | 1 052 832 | 12/1996 |
| WO | WO97/33659 | 9/1997 |
| WO | WO/98/43712 | 10/1998 |

* cited by examiner

*Primary Examiner*—Raeann Gorden
(74) *Attorney, Agent, or Firm*—Brown, Raysman, Millstein, Felder & Steiner

(57) ABSTRACT

A golf ball having improved driving characteristics includes a hard, hollow sphere surrounded by an outer. A second layer may be disposed between the sphere and the outer cover. The hollow sphere is made from a hard material such as a metal, metal alloy, or intermetallic material and may be solid, perforated or porous. The second layer surrounding the sphere is generally made of a natural rubber or synthetic polymer or a combination of each which is surrounded by an outer cover made of an ionomer, urethane or balata. The hard sphere preferably contains a gas. A golf ball of this construction has improved performance characteristics such as low spin rate and further distance.

16 Claims, 2 Drawing Sheets

GOLF BALL

CROSS REFERENCE TO RELATED APPLICATIONS

This application is a continuation of prior U.S. application Ser. No. 09/450,137, filed Nov. 29, 1999, now U.S. Pat. No. 6,705,957, which is a divisional of prior U.S. Application No. 09/008,453, filed Jan. 16, 1998, now U.S. Pat. No. 6,004,225, which claims the benefit of U.S. Provisional Application No. 60/036,196, filed Jan. 21, 1997, all of which are hereby incorporated herein in their entirety by reference.

FIELD OF THE INVENTION

The present invention relates generally to an improved multi-piece golf ball, and more particularly, a multi-piece golf ball including a hollow metal sphere.

BACKGROUND OF THE INVENTION

Various types of regulation golf balls have been proposed. In order to meet the United States Golf Association ("U.S.G.A.") specifications, the golf ball must be spherical in shape, have equal aerodynamic properties and equal moments of inertia about any axis through its center. The ball must have a minimum diameter of 1.68 inches (4.267 centimeters), a maximum weight of 1.620 ounces (45.926 grams), and a maximum initial ball velocity of 255 feet per second as measured on a standard U.S.G.A. ball testing machine.

Golf balls are generally of two kinds, a wound golf ball and a molded golf ball. Because molded golf balls are cheaper to produce and more durable than conventional wound golf balls, efforts have been focused on designing molded balls to improve such characteristics as initial velocity, number of revolutions, angle of departure, moment of inertia, and dimple form. Most golf balls presently manufactured are two-piece balls of uniform density cores throughout.

More recent golf ball designs have, however, focused on solid, multi-piece golf balls wherein the density of the ball is not uniform throughout. For example, U.S. Pat. No. 4,863,167 to Matsuki et al. discloses a three-piece molded golf ball which includes a center portion, an outer layer disposed over the center portion, and a cover disposed over the outer layer. The center and outer layers are formed from a rubber composition containing a base rubber. The rubber composition of the outer layer contains a gravity filler with a high specific gravity such that the outer layer has a higher specific gravity than the center of the solid core. The gravity filler may be selected from tungsten, tungsten carbide, molybdenum, lead, lead dioxide, nickel, or copper.

Other golf ball designs consider both the weight or density distribution of the ball and the relative hardness of the various layers which comprise the golf ball. For example, U.S. Pat. No. 4,979,746 issued to Gentiluomo discloses a two or three piece molded type golf ball having an elastic center. The elastic center has a minimum compressibility of at least ten percent greater than the contacting synthetic elastomer composition which is highly resilient and has a minimum Shore A durometer hardness of about 70. The softer elastic center such as plastic elastomer or rubber, plastic or rubber foam, natural or composition cork, allows each ball to flatten more under club impact, to reduce likelihood of ball breakage and provide for excellent click and feel. When the center is made of low density material, more weight is allowed to be concentrated within the outer portion of the ball to provide a ball exhibiting reduced hooking and slicing action when improperly hit.

U.S. Pat. No. 5,026,067 also issued to Gentiluomo discloses a regulation golf ball comprising a low density center having a maximum diameter of 1.25 inches, a molded encapsulating mass surrounding the center, wherein the material in contact with the center is a highly resilient synthetic elastomer composition having a minimum Shore A durometer hardness of 70 and a specific gravity of 1.0, and a patterned surface contouring of predetermined structure contained within the outer surface of the golf ball. The center has a compressibility of less than ten percent of the compressibility of the material in contact therewith, and a density less than the maximum prevailing density of the encapsulating mass.

U.S. Pat. No. 5,273,286 issued to Sun discloses a multiple concentric section golf ball comprising four sections each having a spherical outer surface, and all sections having a common center. The first section is an inner core closest to the center and consists of substantially incompressible material. The second section is an intermediate core consisting essentially of carbonaceous material, and the third section is an outer core in the form of a shell surrounding the intermediate core which consists essentially of an elastomer. The fourth section is a cover in the form of a shell surrounding the outer core. The radius of gyration and spin rate of the golf ball can be controlled by selection of the weight, density, and size of each of the first, second and third sections.

More recently, U.S. Pat. No. 5,480,155 issued to Molitor et al. discloses a golf ball comprising a hollow, spherical shell of a polymeric material; a unitary, noncellular core of a material which, at the time of introduction into the shell, is a liquid, and a one-piece spherical cover over the center. According to the specification, the spherical shell, as opposed to the core, is primarily responsible for the high initial velocity obtained when the golf ball is struck by a golf club so as to allow the golf ball to be driven long distances. The preferred shell compositions are ionomers. Preferably, the core material has a specific gravity greater than that of the shell.

Except for the ball disclosed in Molitor, the above designs provide for a golf ball wherein the solid core of the golf ball becomes heavier closer to the cover of the ball to improve the moment of inertia thereby improving the spin and flight characteristics. While others have attempted to provide golf ball designs so that the moment of inertia and the spin rate can be controlled by selection of the weight or density and size of the materials comprising the golf ball, these designs are limited in the degree to which the higher density can be concentrated close to the cover or outer edge of the golf ball. Additionally, the use of fillers such as zinc oxide, barium sulfate, calcium carbonate, and other non-polymer compounds to increase the weight distribution of the ball toward the outer core adversely affect other important performance characteristics such as rebound.

Therefore, a golf ball design having a much improved moment of inertia over current golf ball designs which allows the ball to possess improved performance characteristics of low spin for maximum distance while maintaining optimum rebound characteristics is desired.

SUMMARY OF THE INVENTION

It is therefore an object of the present invention to provide a golf ball with an improved moment of inertia by minimizing the density in the center of the ball while maximizing the density away from the center and near the cover or outer edge of the ball, thereby allowing the ball to possess simultaneously the characteristics of low spin for maximum distance and "bite" when landing on a surface such as a putting green.

It is another object of the present invention to provide a golf ball with an improved moment of inertia without adversely affecting the rebound characteristics.

It is yet another object of the present invention to provide a golf ball having improved performance characteristics such as "feel" and flight trajectory.

These and other objects are provided, according to the present invention, by a golf ball having improved driving characteristics which includes a hard hollow sphere and an outer layer surrounding the sphere. In a preferred embodiment, a second layer is placed between the sphere and outer layer so that the second layer surrounds the sphere and is surrounded by the cover.

According to one advantageous embodiment, the sphere consists of a metal, including a metal alloy or an intermetallic, having a specific gravity ranging from about 2.5 to 20 and more preferably about 4.0 to 11.0 and a diameter ranging from about 0.39 to 1.5 inches (1.0 to 3.8 centimeters). The thickness of the sphere wall is about 0.020 to 0.25 inches (0.05 to 0.64 centimeters) and more preferably about 0.02 to 0.08 inches (0.05 to 0.20 centimeters). A metal such as titanium, having a specific gravity of about 4.5, is preferred although other metals or alloys falling within the specific gravity range of about 2.5 to 20 and more preferably about 4 to 11 may be used. Alternatively, a hard plastic or other similar material, such as polypropylene which does not appreciably deform under loads usually placed on a golf ball, may be used to form the hard sphere. Where a hard plastic is used, the specific gravity of the sphere ranges from about 0.8 to 2.0. The plastic sphere may have a thickness of about 0.05 to 0.5 inches (0.13 to 1.27 centimeters).

In another embodiment, a second layer is disposed between the sphere and cover. The second layer preferably consists of a synthetic polymer compound such as polybutadiene, a natural rubber compound, or a combination thereof. The thickness of the second layer is about 0.05 to 0.65 inches (0.13 to 1.65 centimeters) and more preferably about 0.21 to 0.55 inches (0.53 to 1.4 centimeters). The second layer is preferably surrounded by a cover material with a surface dimple pattern as is well-known in the art. The cover typically consists of the material selected from the group consisting of an ionomer, urethane, balata, or synthetic elastomer. Examples of ionomers include material sold under the trade name SURLYN, produced by DuPont Company, or under the trade name IOTEK, produced by Exxon Company. According to another preferred embodiment, the hollow sphere may contain either residual gas, such as air, or a gas at any pressure. The hollow sphere may also contain a solid or liquid material having a density that is less than the density of the outer cover.

Therefore, according to the present invention, a golf ball with improved performance characteristics is provided. In particular, the golf ball contains a hard sphere surrounded by a second layer of compressible material such as polybutadiene. The second layer is then covered by a more durable material such as an ionomer. Thus, the golf ball of the present invention concentrates the weight and, therefore, the density away from the center of the ball to improve its performance characteristics while maintaining optimum rebound characteristics.

DETAILED DESCRIPTION OF THE PREFERRED EMBODIMENT

The present invention now will be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

The inventors of the present invention have discovered that a golf ball comprising a hard hollow sphere increases the moment of inertia and reduces spin, thereby increasing distance. In addition, the golf ball of the present invention provides increased spin retention, i.e. "bite". The golf ball therefore combines the favorable characteristics of existing two-piece and three-piece balls, i.e. distance and "bite." Furthermore, the inventors have discovered that a hollow metal sphere has excellent rebound properties which, when incorporated into a golf ball, can improve its performance.

Figure 1:
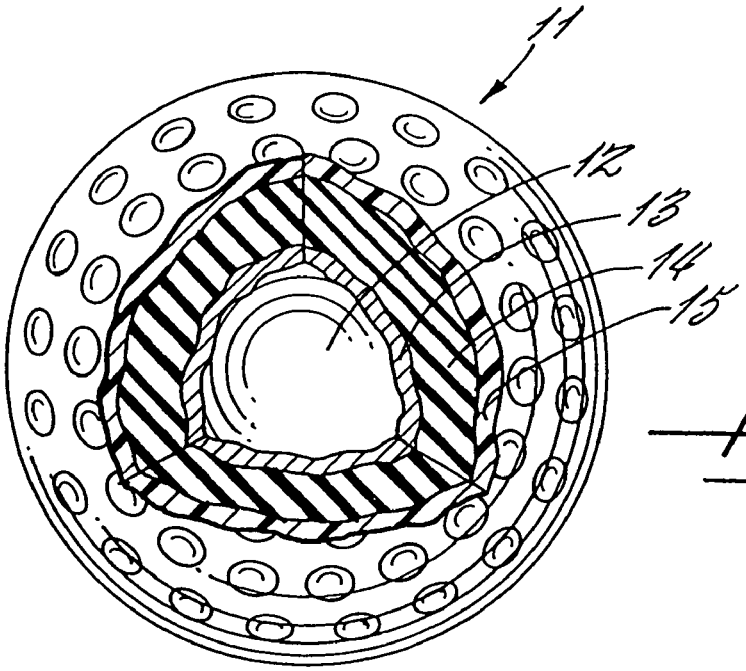
FIG. 1 is a partial cross-sectional perspective view of the golf ball of the present invention.
Figure 2:
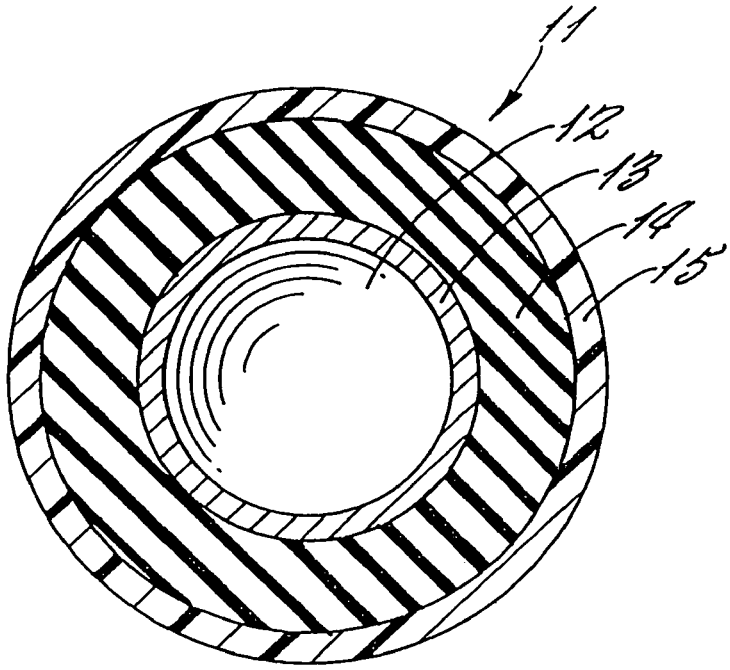
FIG. 2 is a cross-sectional view of a three-piece golf ball of the present invention shown in FIG. 1 wherein a second layer is placed between the sphere and the outer layer.

Referring now to FIGS. 1 and 2, an improved golf ball according to one embodiment of the present invention is illustrated. The golf ball 11 includes a hard, hollow sphere 13 surrounded by a second layer 14. The second layer is then surrounded by an outer cover 15.

The sphere 13 is preferably made of a hard material having a specific gravity ranging from about 2.5 to 20 and more preferably from about 4 to 11, an outside diameter ranging from about 0.39 inches to 1.50 inches (about 1.0 to 3.8 centimeters), and a thickness of about 0.02 to 0.25 inches (0.05 to 0.64 centimeters) and more preferably about 0.02 to 0.08 inches (0.05 to 0.20 centimeters). The hard material comprising the sphere may be any metal such as titanium, a titanium alloy, or other metal alloy including stainless steel, or an intermetallic material such as titanium and aluminum. The metal may also be iron, carbon steel, nickel, molybdenum, aluminum, tungsten or alloys of steel, nickel, aluminum, molybdenum, or tungsten. The metal comprising the sphere may have a Brinnell hardness of greater than 40.

Alternatively, the hard material may be a plastic which does not appreciably deform under loads usually placed on a golf ball such as polypropylene in which case the specific gravity is about 1.0. If plastic, the hollow sphere may have a thickness of about 0.05 to 0.5 inches (0.13 to 1.27 centimeters). The plastic comprising the sphere may have a Shore D hardness of greater than 60. The metal or plastic is preferably solid but may also be perforated or porous. A ceramic, including silicon carbide may be used. The sphere improves the moment of inertia of the ball, thereby reducing spin, by moving the mass away from the center of the ball. The diameter, thickness, and specific gravity of the sphere will vary depending on specific design parameters, including spin rate, feel or rebound, and materials used in construction of the ball.

The second layer 14 is preferably of a compressible, resilient material, including natural rubber or synthetic polymer compounds or a combination thereof which is typically used in the manufacture of golf balls. Examples of such synthetic polymer compounds are polybutadiene, which has a specific gravity of about 1.15, polyisoprene, and styrene-butadiene. Crosslinking or co-crosslinking agents may be added to the rubber comprising the second layer to control its hardness and thus deformation and elastic recovery properties as is well-known in the art. High gravity fillers as are also well known in the art may also be added to the rubber compound comprising the second layer. By using hollow sphere 13 to increase the moment of inertia, however, fillers can be minimized or eliminated from the second layer 14 altogether thereby allowing the use of softer rubber compounds in the second layer to improve rebound characteristics. The second layer 14 may be wound or molded construction. The second layer generally has an outside diameter of about 1.52 to 1.56 inches (3.86 to 3.96 centimeters) and a thickness of 0.05 to 0.65 inches (0.13 to 1.65 centimeters) and more preferably about 0.21 to 0.55 inches (0.53 to 1.4 centimeters). The outer cover 15 may be an ionomer, urethane, balata, or synthetic elastomer. The outer cover also includes a dimple pattern as is well-known in the art.

Figure 3:
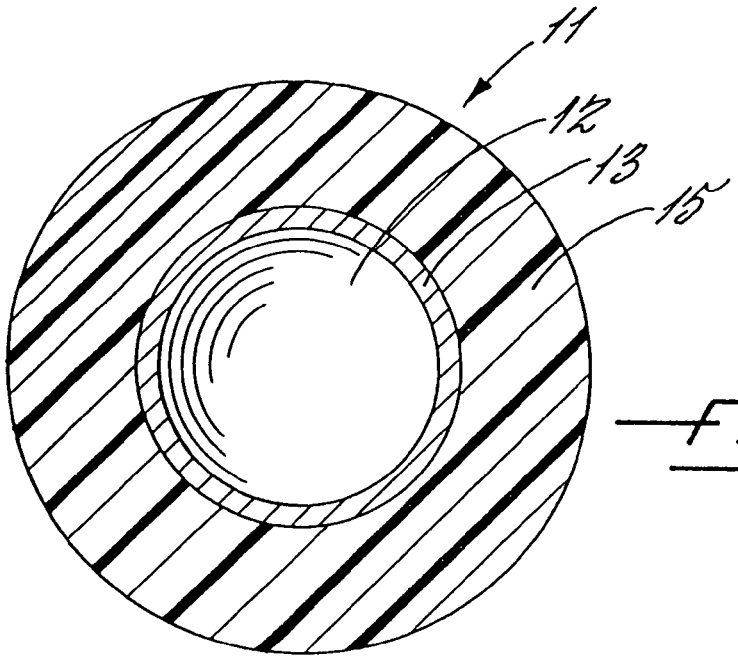
FIG. 3 is a cross-sectional view of a two-piece golf ball of the present invention having a hard sphere surrounded by an outer layer.

Yet another embodiment of the improved golf ball 11 according to one embodiment of the present invention is illustrated in FIG. 3. The golf ball 11 includes a hard sphere 13, as described above, surrounded by an outer cover 15 without a intermediate second layer. The sphere is preferably a metal, and more preferably titanium or stainless steel. This embodiment provides the greatest moment of inertia, less spin, greater rebound and, therefore, greater distance.

Figure 4:
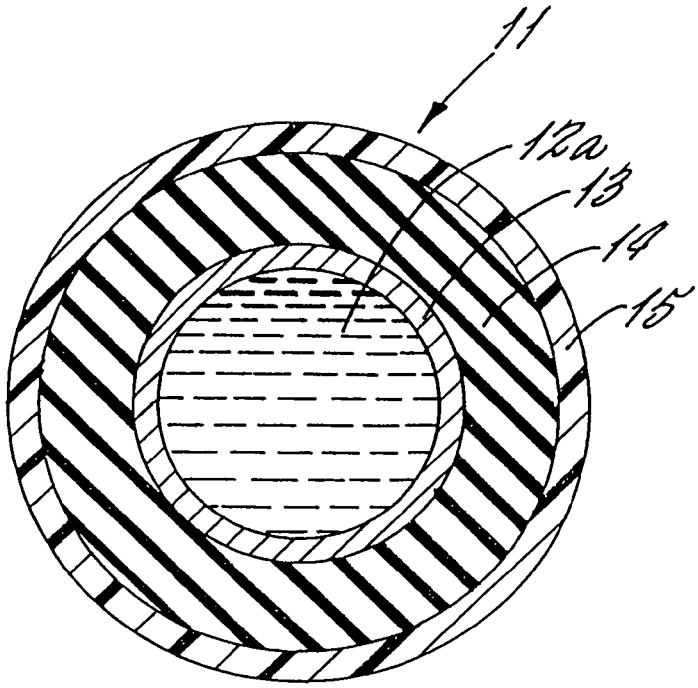
FIG. 4 is a cross-sectional view of the three-piece golf ball of the present invention which has a solid or liquid material inside of the sphere.

In a preferred embodiment of the invention as shown in FIG. 2, the hollow sphere 13 is not filled with any solid or liquid material. Thus, the hollow sphere contains a residual gas 12, preferably air. The hollow sphere may also contain pressurized gas. Preferably, the gas fills or substantially fills the hollow sphere. In another embodiment as shown in FIG. 4, the hollow sphere may contain a solid or liquid-based material 12*a*. Preferably, any solid or liquid material which may be placed inside the sphere is of lower density than the material comprising the second layer or outer cover surrounding the sphere in order to increase the moment of inertia of the ball. Suitable solid materials may include natural rubber or synthetic polymer, cork, or plastics. Suitable liquid materials include water and oil. Vegetable or mineral oils may be used. If a solid material is used, the solid material may be comprised of layers of different materials. The outer cover 15 may be an ionomer, urethane, balata, or synthetic elastomer. The outer cover also includes a dimple pattern as is well known in the art.

Preferably, the golf ball 11 of the present invention has a minimum diameter of 1.68 inches, a maximum weight of 1.620 ounces, and a maximum initial ball velocity of 255 feet per second as measured on a standard U.S.G.A. ball testing machine.

The golf ball 11 may be made using conventional processes and techniques as are presently employed in the art such as molding so that the ball will be spherical in shape, have equal aerodynamic properties, and have equal moments of inertia about any axis through its center. If plastic, the hollow sphere 13, may be made by techniques, such as blow molding, which are well-known in the art. If metal, the hollow sphere 13 may be manufactured by forming two halves of a sphere by hot forming or cold forming which are then joined together by welding or other means sufficient to securely join the halves of the sphere together. Methods of forming two halves of a metal sphere include stamping, hydroforming, metal spinning, and superplastic forming as are well-known in the art. Methods of securely joining two halves of a metal sphere include welding (such as electron beam welding, laser welding, and electrical resistance welding) or metal gluing as are well-known in the art. Metal spheres suitable for use according to the present invention can be obtained from Industrial Tectonics, located in Dexter, Mich. The outer layer and, if desired, the second layer are molded around the sphere using techniques that are well-known in the art. Alternatively, the second layer, or any additional layers, may be wound as is well-known in the art.

Examples of golf balls made according to the present invention are shown below:

EXAMPLE 1

Two Piece ball—Titanium core and SURLYN (manufactured by DuPont and registered tradename) cover according to the following specifications:

A hollow sphere comprising a titanium shell with an inside diameter of 1.374 inches (3.490 centimeters), outside diameter of 1.521 inches (3.863 centimeters), and a mass of 1.258 ounces (35.69 grams).

SURLYN cover with a density of 58.68 lb/ft$^3$ (0.95 grams/cm3), an inside diameter of 1.521 inches (3.863 centimeters), an outside diameter of 1.680 inches (4.267 centimeters) and a mass of 0.3514 ounces (9.962 grams). The residual gas in the core does not contribute significantly to the mass of the ball. The total mass of the ball is 1.610 ounces (45.65 grams). The moment of inertia of the ball of Example 1 is about 34 percent greater than a typical two-piece ball.

EXAMPLE 2

Three piece ball—Titanium core, second layer of polybutadiene, and a SURLYN cover:

A hollow sphere comprising a titanium shell with an inside diameter of 0.992 inches (2.52 centimeters) and an outside diameter of 1.102 inches (2.80 centimeters), a specific gravity of 4.5 and a mass of 0.494 ounces (14.0 grams).

Polybutadiene (specific gravity=1.15) with a layer thickness of 0.210 inches (0.53 centimeters) and a mass of 0.762 ounces (21.61 grams).

SURLYN (specific gravity=0.95) cover of thickness 0.0787 inches (0.2 centimeters), and a mass of 0.348 ounces (9.87 grams).

The residual gas inside the core does not contribute significantly to the mass of the ball. The total mass of the ball is 1.604 ounces (45.5 grams). The moment of inertia of the ball of Example 2 is about six percent greater than a typical two-piece ball.

As described above, the improved golf ball of the present invention provides improved performance characteristics including low spin rate, long distance, and bite without adversely affecting rebound characteristics. The ball of the present invention minimizes hook and slice when improperly hit. The design of the golf ball allows variations in the material and the size of the sphere, second layer, and outer cover in order to optimize performance characteristics.

In the drawings and specification there has been set forth preferred embodiments of the invention and although specific terms are employed, the terms are used in a generic and descriptive sense only and not for the purpose of limiting the scope of the invention being set forth in the following claims.

What is claimed is:

1. A modem golf ball comprising:

a cover material defining an inner surface and an outer surface, said outer surface having a dimpled pattern;

a single, one-piece metal sphere having an outer surface which is surrounded by the inner surface of the cover, said single sphere further defining an inner surface surrounding a material of lower density than the density of said cover material; and said single sphere further defining a wall formed of a metal having a thickness between said inner and outer surfaces of said sphere of at least 0.020 inches.

2. A modem golf ball as defined in claim 1, wherein the metal is selected from the group consisting of titanium and titanium alloys.

3. A modern golf ball as defined in claim 1, wherein said single sphere is comprised of two or more spherical portions each formed by stamping, said portions of said sphere being fixedly secured together to form said single sphere.

4. A modem golf ball as defined in claim 1, wherein said single sphere is comprised of two or more spherical portions each formed by hydroforming, said portions of said sphere being fixedly secured together to form said single sphere.

5. A modem golf ball as defined in claim 1, wherein said single sphere is comprised of two or more spherical portions each formed by superplastic forming, said portions of said sphere being fixedly secured together to form said single sphere.

6. A modem golf ball as defined in claim 1, wherein said single sphere is comprised of two or more spherical portions each formed by metal spinning, said portions of said sphere being fixedly secured together to form said single sphere.

7. A modem golf ball as defined in claim 3, wherein said portions of said sphere are fixedly secured together by welding.

8. A modern golf ball as defined in claim 7, wherein said welding is electron beam welding.

9. A modern golf ball as defined in claim 7, wherein said welding is laser welding.

10. A modem golf ball as defined in claim 7, wherein said welding is electrical resistance welding.

11. A modern golf ball as defined in claim 3, wherein said portions of said sphere are fixedly secured together by gluing.

12. A modern golf ball as defined in claim 1, wherein said wall has a thickness of about 0.02 inches to about 0.08 inches.

13. A modem golf ball as defined in claim 1, wherein said single sphere has an outer diameter of between about 0.39 inches and about 1.5 inches.

14. A modem golf ball as defined in claim 1, wherein the material of lower density in said sphere comprises a gas.

15. A modem golf ball as defined in claim 14, wherein said gas is under pressure.

16. A modem golf ball as defined in claim 14, wherein said gas is air.

* * * * *

UNITED STATES PATENT AND TRADEMARK OFFICE

CERTIFICATE OF CORRECTION

PATENT NO. : 6,976,925 B2
APPLICATION NO. : 10/756185
DATED : December 20, 2005
INVENTOR(S) : Timothy M. Owens et al.

It is certified that error appears in the above-identified patent and that said Letters Patent is hereby corrected as shown below:

On the cover page, item [73] the Assignee should be changed to --Noonan, LLC., Summerfield, SC (US)--

Signed and Sealed this

Sixteenth Day of January, 2007

JON W. DUDAS
*Director of the United States Patent and Trademark Office*